US006246020B1

(12) United States Patent
Sato

(10) Patent No.: US 6,246,020 B1
(45) Date of Patent: Jun. 12, 2001

(54) MICRO SWITCH HAVING SILVER CONTAINING CONTACTS

(75) Inventor: Masami Sato, Saitama (JP)

(73) Assignee: Kabushiki Kaisha Saginomiya Seisakusho, Tokyo (JP)

( * ) Notice: Subject to any disclaimer, the term of this patent is extended or adjusted under 35 U.S.C. 154(b) by 0 days.

(21) Appl. No.: 09/242,734

(22) PCT Filed: Jun. 19, 1998

(86) PCT No.: PCT/JP98/02732

§ 371 Date: Feb. 23, 1999

§ 102(e) Date: Feb. 23, 1999

(87) PCT Pub. No.: WO99/00813

PCT Pub. Date: Jan. 7, 1999

(30) Foreign Application Priority Data

Jun. 30, 1997 (JP) ..... 9-174924
Jun. 9, 1998 (JP) ..... 10-160951

(51) Int. Cl.[7] ..... H01H 1/04
(52) U.S. Cl. ..... 200/263; 200/265
(58) Field of Search ..... 200/263, 265, 200/266, 456, 454

(56) References Cited

U.S. PATENT DOCUMENTS 2,365,249 * 12/1944 Comstock ..... 200/263
2,819,362 * 1/1958 Korsgren ..... 200/456
4,180,715 * 12/1979 Lichtenberger ..... 200/263 X

FOREIGN PATENT DOCUMENTS 59-123108 7/1884 (JP) .
56-107639 8/1981 (JP) .
58-44624 3/1983 (JP) .
6-228678 8/1994 (JP) .

* cited by examiner

*Primary Examiner*—Renee Leubke
(74) *Attorney, Agent, or Firm*—McDermott, Will & Emery

(57) ABSTRACT

A micro switch includes a fixed contact and a movable contact. One is made of silver-carbon sintered metal, and the other is made of a silver-metal oxide alloy. The silver-carbon sintered metal includes carbon powder particles sufficiently small in average size to be capable of plastic molding into a sintered metal. The contact made of the silver-carbon sintered metal is directly crimped onto a contact supporting plate.

2 Claims, 3 Drawing Sheets

MICRO SWITCH HAVING SILVER CONTAINING CONTACTS

TECHNICAL FIELD

The present invention relates to a micro switch, particularly, a micro switch for use in an air conditioner, a freezer, a heater, and the like.

BACKGROUND ART

In electrical equipment such as air conditioners, freezers, and heaters, micro switches have found advantageous application in temperature control including thermostat control, which enables on-off control of large amounts of electrical power without using a relay. Such micro switches have a fixed contact, a movable contact, and a snap-action device. The snap-action device moves the movable contact in or out of contact with the fixed contact to open and close an associated electric circuit.

The fixed and movable contacts of the micro switch have been conventionally made of silver, a silver-carbon sintered metal, a silver-metal oxide alloy, or the like. Particularly, most micro switches have been made of a silver-metal oxide alloy that exhibits outstanding performance with respect to mutual welding of the contacts and consumption of the contacts due to arc discharge.

Japanese Patent Application Laid-open No. 59-123108 discloses a pair of contacts each of which is made of a material having a different characteristic. One of the contacts is made of a silver-tungsten carbide (Ag-WC) sintered metal, while the other is made of an Ag-$SnO_2$ alloy (viz., a silver-metal oxide compound alloy.

A commonly used micro switch for a large current has been made of a silver-metal oxide alloy that has an outstanding performance against mutual welding of the contacts and against consumption by arc discharge. However, the alloy has the disadvantage of a larger contact resistance to cause a substantial temperature rise at its associated contacts when energized as compared with silver or a silver-carbon sintered metal.

Thus, when both the movable contact and the fixed contact are made of silver-metal oxide alloy, a contact point temperature of the pair of contacts becomes elevated because of a larger contact resistance, disadvantageously affecting an electrical performance thereof. To solve this problem, it is required that the pair of contacts have a larger diameter to increase the contact area thereof for reducing the contact resistance, or that there is provided with an auxiliary plate having a high thermal conductivity for heat radiation.

The enlargement in diameter of the contacts without modifying the switch case in size, decreases clearances between the contacts and other parts, causing a possibility of an arc discharge therebetween. Particularly, a micro switch having a snap-action device consisting of a resilient plate and a U-shaped, snap-action spring raises the problem that the snap-action spring is located very close to the fixed contact, inviting an arc discharge therebetween. Since the snap-action spring is joined to a free end portion of the resilient plate supported by the switch case at one end thereof, and is joined to a movable contact supporting plate having a contact at the other end thereof, the fixed contact must be partially cut away in a side thereof opposed to the snap-action spring, for example, into a D-shape configuration.

Meanwhile, contacts which are both made of a silver-carbon sintered metal do not encounter the above problems.

However, the silver-carbon sintered metal, is disadvantageous as compared with a silver-metal oxide alloy in connection with mutual welding of the contacts and consumption of the contacts due to arc discharge. The contacts made of a silver-carbon sintered metal thus have a shorter life. In addition, a silver-carbon sintered metal has a comparatively higher toughness, which hinders plastic molding and is not suitable for a die-cut flat conductor or a contact plate because they can not be directly crimped onto a contact supporting plate.

Japanese Patent Application Laid-open No. 59-123108 discloses a pair of contacts, one of which is made of a silver-tungsten carbide sintered metal, while the other is made of a silver-metal oxide compound alloys. However, this combination is not suitable with respect to preventing mutual welding of the contacts and contact resistance to obviate heating of the contacts. Moreover, it requires a tungsten carbide that has been heat-treated at a high temperature.

SUMMARY OF THE INVENTION

In view of the above problems, an object of the invention is to provide a micro switch having an acceptable performance with respect to mutual welding and against consumption by arc discharge. Moreover, the micro switch does not require an auxiliary contact support and improves its contact elements with respect to miniaturization and electrical life. The contact elements can be directly crimped on a contact supporting plate, which simplifies mounting.

For achieving this and other objects, a first aspect of the invention resides in a micro switch including a fixed contact, a movable contact, and a snap-action device, the snap-action device moving the movable contact in or out of contact with the fixed contact.

In addition, one of the fixed and movable contacts is made of a silver-carbon sintered metal, and the other is made of a silver-metal oxide alloy.

A second aspect of the invention resides in a specified micro switch of the above-mentioned type, wherein the silver-carbon sintered metal includes a carbon power that consists of particles sufficiently small in average size to enable plastic molding of the silver-carbon sintered metal.

One of these contacts is directly crimped and secured to a contact supporting plate.

A third aspect of the invention is a micro switch similar to the second aspect but wherein the silver-carbon sintered metal is made of a silver powder mixed with a carbon powder having an average particle size not more than 1 $\mu$m, the carbon powder being 0.01 to 0.5% in weight to the silver powder.

A fourth aspect of the invention resides in a micro switch similar to the first configuration but which further includes: a switch case enclosing the fixed and the movable contacts, a pair of first and second terminal pieces respectively electrically connected with the fixed contact or the movable contact, and a movable-contact supporting plate resiliently cantilevered from the switch case, wherein the movable contact is secured to a free end portion of the movable-contact supporting plate, and the snap-action device comprises a resilient plate and a U-shaped, snap-action spring, one end of the resilient plate being secured to the switch case, the snap-action spring being joined at one end thereof to a free end portion of the resilient plate and being joined at the other end thereof to a free end portion of the movable contact supporting plate.

In accordance with the first aspect of the invention, one of the fixed and movable contacts is made of a silver-carbon sintered metal, while the other is made of a silver-metal oxide alloy. This combination of materials having different characteristics compensates for the respective weakness and/or shortcomings of the materials compared with a pair of contacts made of a single material, providing adequate resistance with respect to mutual welding of the contacts and with respect to consumption of the contacts due to arc discharge. This compatibly allows a reduction in contact resistance of the pair of contacts.

In the second aspect of the invention, the micro switch has one contact made of a silver-carbon sintered metal which is capable of plastic molding. The contact is directly crimped on the contact supporting plate.

In the third aspect of the invention, the silver-carbon sintered metal is made of a silver powder mixed with a carbon powder having an average particle size not more than 1 $\mu$m, the carbon powder being 0.01 to 0.5% in weight to the silver powder.

In the fourth aspect of the invention, the fixed contact connects to the first terminal piece so as to be secured to the switch case. The movable contact is secured to the free end portion of the movable-contact supporting plate, and the snap-action device comprises the resilient plate and the U-shaped, snap-action spring, one end of the resilient plate being secured to the switch case, the snap-action spring being joined at one end thereof to a free end portion of the resilient plate and being joined at the other end thereof to a free end portion of the movable contact supporting plate. The snap-action device can move the movable contact toward and from the fixed contact with a high speed. This combination of the materials prevents a temperature rise of the contacts, avoids the need for a larger diameter to increase the contact areas thereof. In addition, without enlarging the micro switch, sufficient space is maintained between the contacts and the snap-action spring to obviate an arc discharge therebetween.

DETAILED DESCRIPTION OF THE PREFERRED EMBODIMENT

Referring to the accompanied drawings, an embodiment of the invention will be discussed in detail hereinafter.

Figure 1:
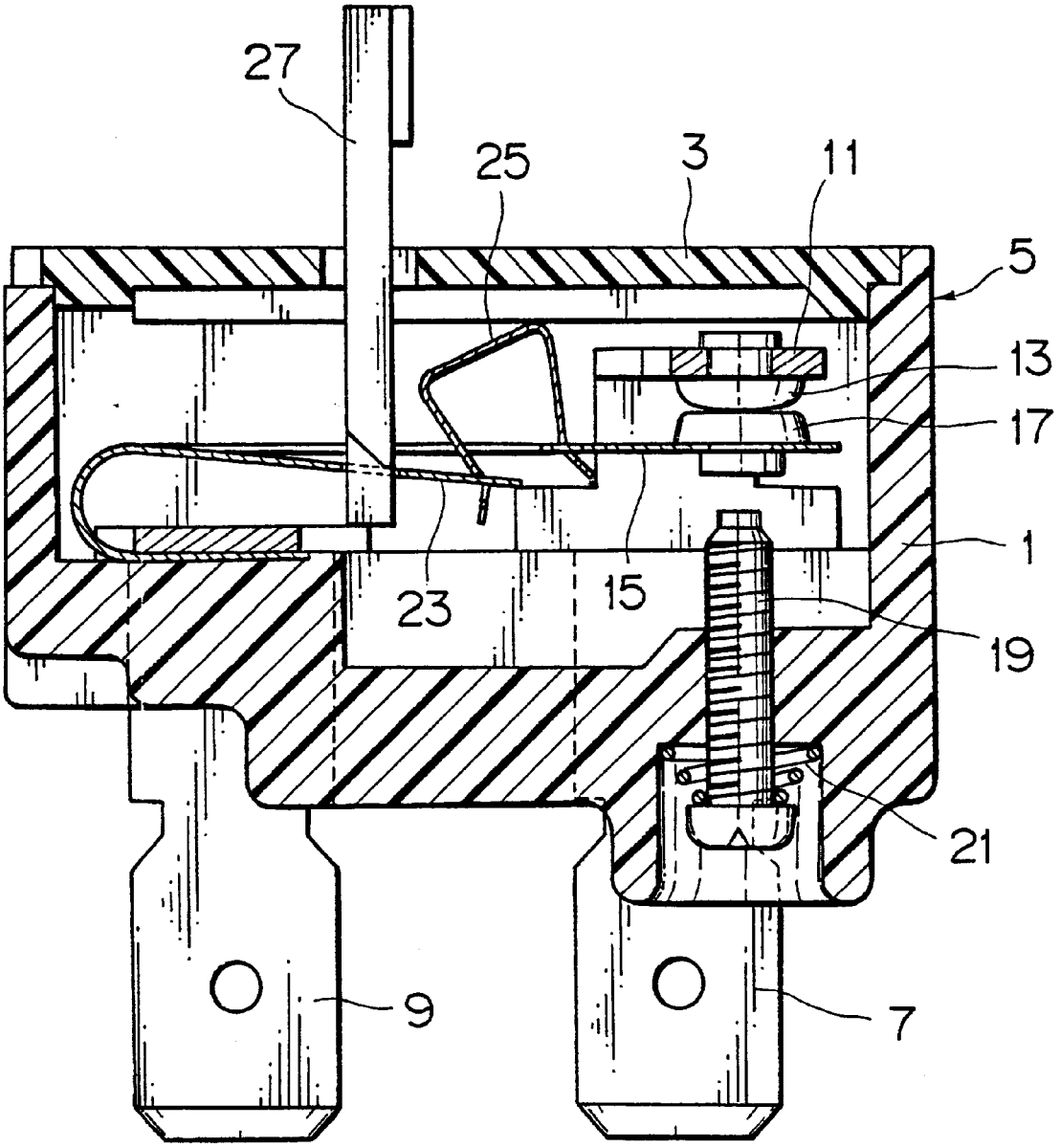
FIG. 1 is a sectional view of an embodiment of a micro switch according to the invention, in which a pair of contacts are closed.
Figure 2:
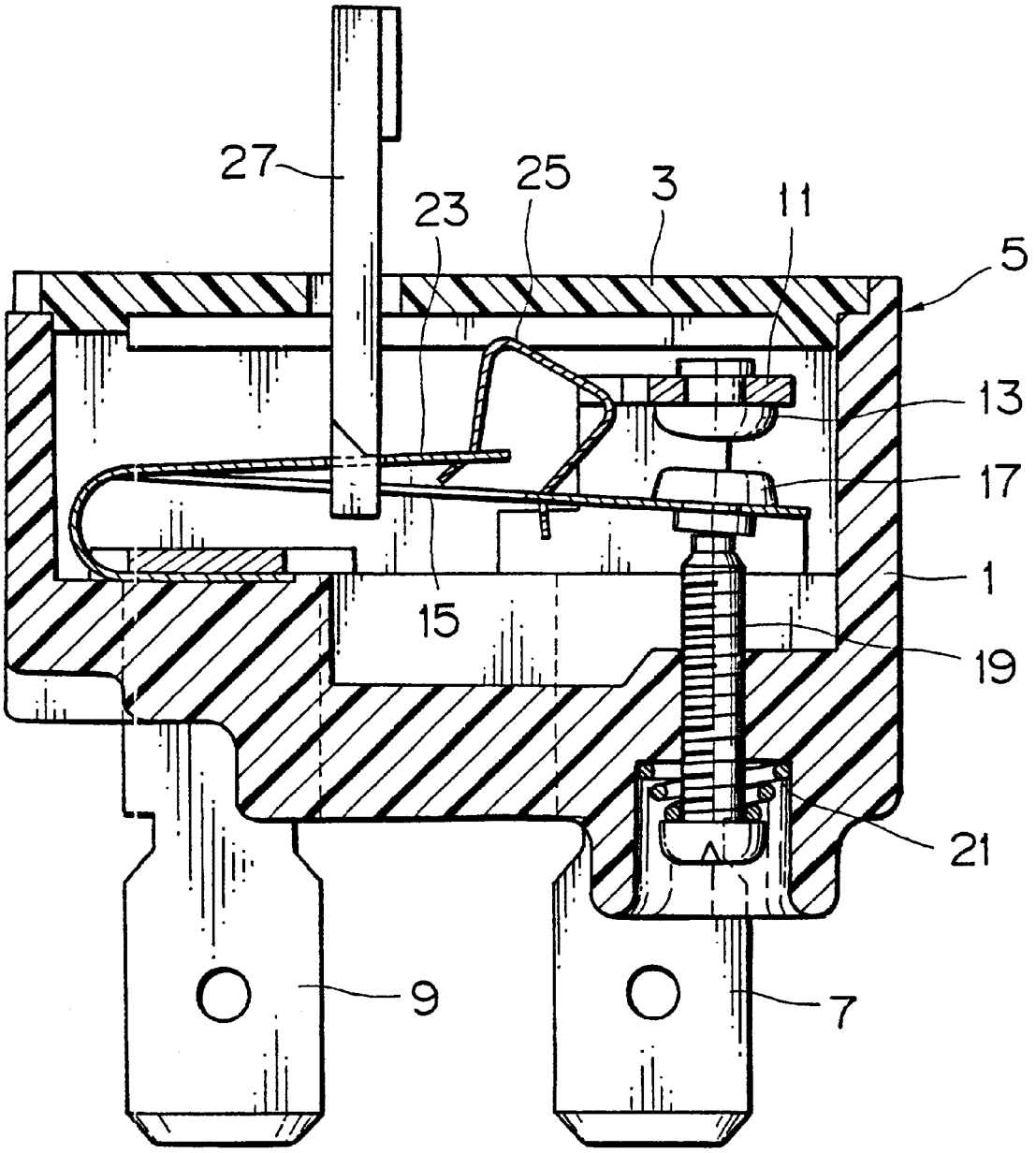
FIG. 2 is a sectional view of the embodiment of the micro switch according to the invention, in which contacts are opened.

FIGS. 1 and 2 show an embodiment of a micro switch according to the invention. The micro switch has a switch case 5 that consists of a terminal housing 1 made of an electrical insulating material and a terminal cover 3. The terminal housing 1 has a fixed contact side terminal piece 7 and a movable contact side terminal piece 9, each of which is inserted into and secured to the housing.

The terminal piece 7 has an angled contact support 11 integrally disposed in the switch case 5. The contact support 11 is provided with a button-shaped, fixed contact 13 secured to a lower surface of the support. The terminal piece 9 and the terminal housing 1 clamp one end of the movable contact supporting plate 15 therebetween in the switch case The supporting plate 15 has a resilient plate portion 23 U-shaped in a longitudinal direction thereof. Thus, the movable contact supporting plate 15 is cantilevered from the switch case 5 and electrically connects with the terminal piece 9. The movable contact supporting plate 15 has a button-shaped movable contact 17 on an upper surface of a free end side of the plate 15.

The free end of the supporting plate 15 is under the contact support 11, so that the movable contact 17 is opposed to the fixed contact 13 with a small space therebetween. The terminal housing 1 is mounted with a contact gap adjusting screw 19 and a spring washer 21 for adjusting a space between the pair of contacts.

Between a free end side of the resilient plate portion 23 and a free end side of the movable contact supporting plate 15, there is mounted a U-shaped snap-action spring 25 each end of which is joined to each free end of the plate portion 23 or the supporting plate 15. The resilient plate portion 23 is connected to a rod actuator 27 for opening and closing the micro switch.

In the micro switch, pushing down on the actuator 27 causes a snap-action of the snap-action device so that the movable contact 17 is moved upward to abut against the fixed contact 13 to close the pair of contacts and thus assume the closed state illustrated in FIG. 1. On the other hand, lifting the actuator 27 up causes a reverse snap-action of the snap-action device so that the movable contact 17 is moved downward and separates from the fixed contact 13 with the result that the contacts and assume the open condition illustrated in FIG. 2.

The constructed snap-action device moves the movable contact 17 with a high speed when the contacts open or close, allowing a clearly recognizable switching operation in the micro switch.

The fixed contact 13 is made of a silver-metal oxide alloy such as Ag-In-$SnO_2$. On the other hand, the movable contact 17 is made of a silver-carbon (Ag-Gr.) sintered metal. The silver-carbon sintered metal consists of a silver powder that is mixed with a carbon powder of 0.01 to 0.5% in weight. The carbon powder has an average particle size not more than 1 $\mu$m, more specifically not more than 0.1 $\mu$m. The sintered metal is capable of plastic molding and also resists mutual welding of the contacts. Accordingly, the movable contact 17 can be directly crimped on and secured to the supporting plate 15.

The average particle size of the carbon powder that is not more than 1 $\mu$m, more specifically not more than 0.1 $\mu$m reduces the carbon weight percentage from about 5% to 0.01 to 0.5%. The carbon weight percentage is a minimum with respect to mutual welding of the contacts. This renders the silver-carbon sintered metal capable of plastic molding.

When the average particle size of the carbon powder is more than 1 $\mu$m, the carbon percentage must be increased to prevent mutual welding of the contacts, but this is disadvantageous with respect to plastic molding. In this case, a carbon weight percentage not more than 0.01 is disadvantageous with respect to mutual non-welding performance while a carbon weight percentage more than 0.5 is disadvantageous with respect to plastic molding.

The silver-carbon sintered metal described above for providing the electrical contact may be replaced by a material that is disclosed in Japanese Patent Application Laid-open No. 6-228678.

As described above, the movable contact 17 is made of a silver-carbon sintered metal, and the fixed contact 13 is made of a silver-metal oxide alloy. This combination of the materials having different characteristics compensates for the weakness of the individual materials and obviates mutual welding of the contacts and consumption due to arc discharge. This compatibly also allows for a reduction in contact resistance of the pair of contacts and prevents a temperature rise of the contacts. This leads to an improved durability and a longer working life.

Moreover, it is not required that the pair of contacts 13, 17 have a large diameter to increase the contact area thereof nor an auxiliary plate having a high thermal conductivity for heat radiation. This allows a micro switch of a miniaturized design consisting of few parts.

As described above, it is not required that the fixed contact 13 has a larger diameter to increase the contact area thereof. In addition, without enlarging the micro switch, a sufficient space is maintained between the fixed contact 13 and the snap-action spring 25 avoiding an arc discharge therebetween. Thus, the micro switch has improved durability and an outstanding reliable electrical performance. The movable contact 17 that is made of the silver-carbon sintered metal is directly crimped on the supporting plate 15, which facilitates easy mounting of the contact.

Regarding the above-mentioned embodiment of the invention, a comparative performance evaluation test is discussed hereinafter comparing a known arrangement in which both the fixed contact and the movable contact are made of a silver-metal oxide alloy Ag-In-$SnO_2$.

A plurality of test models were mounted in a pressure-actuated thermostat. Then, the following electrical load was applied to the switches and air pressure was applied to the actuator 27 by way of a capillary tube for opening and closing the contacts. The test checked the presence or absence of mutual welding of the contacts, the transition of the welded points, and the degree of consumption of the contacts.

The presence of the mutual welding of the contacts was determined by recognizing a current shutdown delay (an extended energized state) not less than one second greater than a predetermined contact opening and closing period according to an air pressure applied through the capillary tube. When a mutual welding of the contacts occurred, the test was interrupted. At that time, when the contacts could open by themselves since the mutual welding was only slight the endurance test was continued. When the contacts could not open by themselves, it was determined that there was a complete mutual welding of the contacts.

Electrical load condition;

Voltage: 250V AC

Current i1: 80A (cos Ø=0.45)

Current i2: 20A (cos Ø=0.75)

Current i1: energized period t1: 0.2 sec

Current i2: energized period t2: 0.8 sec

Non-energized period t3: 9 sec

Load frequency: 6 cycles/minute

Figure 3:
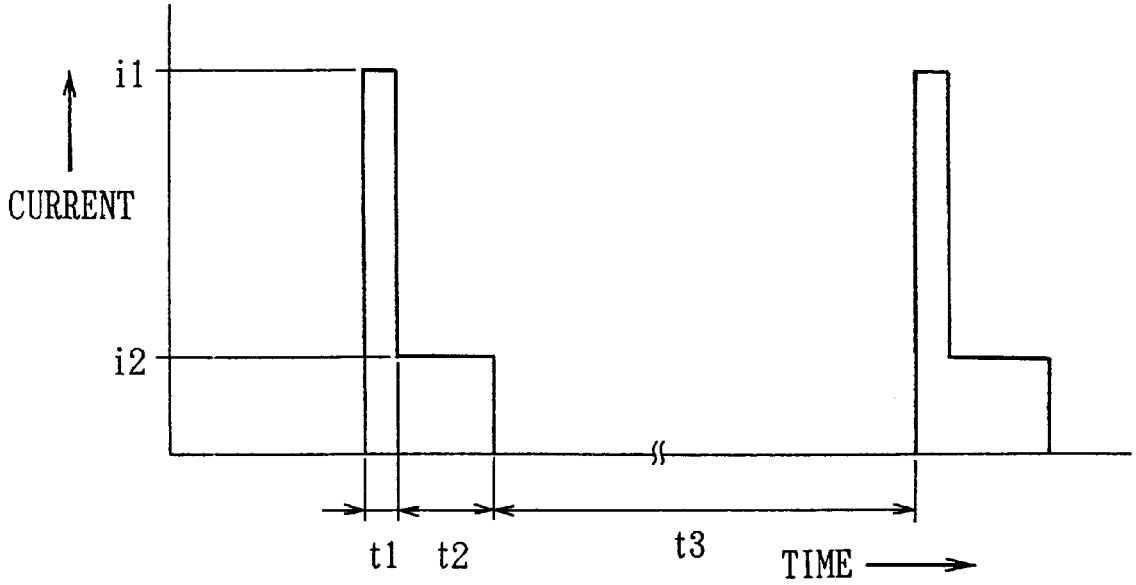
FIG. 3 is a graph showing an energized wave form in a comparative performance evaluation test of the switch.

An energized wave form based on this electrical load condition is shown in FIG. 3.

The evaluation test result is shown in Table 1.

TABLE 1

| | Test Model | known Model |
|---|---|---|
| Slight Welding Occurrence | four of five models after 240,000 cycles | five of five models after 120,000 cycles |
| Complete Welding Occurrence | none up to 300,000 cycles | two of five models between 220,000 and 300,000 cycles |
| Contact Resistance (Maximum) (In One Ampere) | 10 m Ω(Maximum) | 39 m Ω |
| Contact Temperature Increase | 34.5 to 50 ° C. | 48 to 63 ° C., |

Referring to the test result in Table 1, a slight mutual welding of contacts occurred in every one of the known micro switches after 120,000 on-off cycles. A complete mutual welding of contacts occurred in two of the five known micro switches between 220,000 and 300,000 cycles, in which the contact resistance rose up to 39 m Ω and the contact point temperature rose up to 63° C. Meanwhile, in test model micro switches according to the invention, a slight mutual welding of contacts occurred in four of the five models after 240,000 on-off cycles. No complete mutual welding of contacts occurred in the five models up to 300,000 cycles, in which the contact resistance rose up to 10 m Ω and the contact point temperature is maintained at not more than 50° C., resulted in an outstanding performance of the test models.

INDUSTRIAL APPLICABILITY

The micro switch according to the first aspect described above can prevent a temperature increase of the contacts to provide an improved durability and a longer working life of the contacts. Moreover, it is neither required that the pair of contacts have a larger diameter to increase the contact area thereof for reducing the contact resistance nor an auxiliary plate having a high thermal conductivity for heat radiation. This allows an improved design in miniaturization and few parts. In the micro switch according to the second aspect, the contact is easy mounted in assembling, allowing a reduction in manufacturing cost.

In the micro switch of the third configuration, there is no need for increasing the fixed contact in diameter to keep the micro switch in the same size. The fixed contact and the snap-action spring have an enough space therebetween to prevent arc discharge. Thus, the contacts improve in durability to have an outstanding, reliable electrical performance over a long time. Similarly, in the micro switch according to the fourth aspect enables sufficient space to be maintained between the contacts and the snap-action spring not to generate an arc discharge therebetween. Thus, the contacts improve in durability to have an outstanding, reliable electrical performance.

What is claimed is:

1. A micro switch comprising a fixed contact, a movable contact, and a snap-action device, said snap-action device moving said movable contact to be in or out of contact with said fixed contact, wherein one of said fixed contact and movable contact is made of a silver-carbon sintered metal, and the other is made of a silver alloy including $SnO_2$, said silver-carbon sintered metal includes a carbon powder that consists of particles sufficiently small in average size to be capable of plastic molding of said silver-carbon sintered metal, said one of the contacts is directly crimped on and secured to a contact supporting plate, and wherein said silver-carbon sintered metal is made of a silver powder mixed with a carbon powder having an average particle size not more than 1 $\mu$m, said carbon powder being 0.01 to 0.5% in weight to said silver powder.

2. A micro switch comprising:

a switch case enclosing a fixed and a movable contacts, a pair of first and second terminal pieces respectively electrically connected with the fixed contact or said movable contact, and a movable-contact supporting plate resiliently cantilevered from said switch case, said movable contact being secured to a free end portion of said movable-contact supporting plate, and a snap-action device including a resilient plate and a U-shaped, snap-action spring, one end of said resilient plate being secured to said switch case, said snap-action spring being joined at one end thereof to a free end portion of said resilient plate and being joined at the other end thereof to a free end portion of said movable contact supporting plate, wherein one of said fixed contact and movable contact is made of a silver-carbon sintered metal, and the other is made of a silver alloy including $SnO_2$, said silver-carbon sintered metal includes a carbon powder that consists of particles sufficiently small in average size to be capable of plastic molding of said silver-carbon sintered metal, said one of the contacts is directly crimped on and secured to a contact supporting plate, and said silver-carbon sintered metal is made of a silver powder mixed with a carbon powder having an average particle size not more than 1 $\mu$m, said carbon powder being 0.01 to 0.5% in weight to said silver powder.

* * * * *